US005738543A

United States Patent [19]

Rollins et al.

[11] Patent Number: 5,738,543

[45] Date of Patent: Apr. 14, 1998

[54] CONNECTOR WITH TERMINAL POSITION ASSURANCE MEMBER

[75] Inventors: Brian Rollins, Cheshunt; Richard Johnathon Howells, St. Albans, both of Great Britain

[73] Assignee: The Whitaker Corporation, Wilmington, Del.

[21] Appl. No.: 831,032

[22] Filed: Apr. 1, 1997

[30] Foreign Application Priority Data

Apr. 26, 1996 [GB] United Kingdom ..... 9608746

[51] Int. Cl.[6] ..... H01R 13/422

[52] U.S. Cl. ..... 439/595

[58] Field of Search ..... 439/595, 598

[56] References Cited

U.S. PATENT DOCUMENTS

| | | | |
|---|---|---|---|
| 4,343,523 | 8/1982 | Cairns et al. | 339/59 M |
| 4,357,066 | 11/1982 | Cairns et al. | 339/176 MP |
| 4,431,252 | 2/1984 | Cairns et al. | 339/176 MP |
| 4,867,711 | 9/1989 | Yuasa | 439/752 |
| 5,044,991 | 9/1991 | Colleran et al. | 439/595 |
| 5,061,210 | 10/1991 | Jinno | 439/752 |
| 5,066,252 | 11/1991 | Kato et al. | 439/752 |
| 5,085,599 | 2/1992 | Maejima et al. | 439/598 |
| 5,100,345 | 3/1992 | Endo et al. | 439/595 |
| 5,281,168 | 1/1994 | Krehbiel et al. | 439/595 |
| 5,358,427 | 10/1994 | Miwa | 439/595 |
| 5,389,014 | 2/1995 | Kümpel et al. | 439/752 |
| 5,462,458 | 10/1995 | Sagawa | 439/752 |
| 5,509,828 | 4/1996 | Muta et al. | 439/699.2 |

*Primary Examiner*—Neil Abrams
*Attorney, Agent, or Firm*—Bradley N. Ditty

[57] ABSTRACT

An electrical connector comprises a first housing member and a terminal position assurance member. The terminal position assurance member is fully received within the housing such that it can not be accidentally depressed into the fully locked position during handling and transport. The terminal position assurance member is moveable from a pre-assembly to a fully locked position in a direction transverse to the mating direction such that the housing has a substantially flush front face to enable the connector to be mated against a wall or similar structure in a compact manner. Movement of the terminal position assurance member in the transverse direction ensures that the outer shroud of the connector does not extend beyond the mating face of the connector, thereby providing a compact arrangement.

11 Claims, 4 Drawing Sheets

CONNECTOR WITH TERMINAL POSITION ASSURANCE MEMBER

BACKGROUND OF THE INVENTION

1. Field of the Invention

This invention relates to an electrical connector having a terminal position assurance member for ensuring that electrical terminals are securely held in the housing.

2. Description of the Prior Art

Certain electrical connectors are provided with housings having cavities extending therethrough for receiving terminals, each cavity provided with a resilient locking lance integrally molded with the housing for locking a terminal inserted therein. In order to further secure the terminals within the housing, it is common to provide a secondary housing member that is moveable against the locking lances to prevent the locking lances from outwardly biasing. In other words, the locking lances are blocked into their latching position. It is known to provide the secondary member pre-assembled to the housing in a pre-assembly position that allows insertion of the terminals into the connector cavities. The secondary member can then be moved to a fully locked position whereby the terminals are locked in the cavities.

In many systems, the secondary member is protected by a shroud that extends beyond a mating face of the connector, to prevent the secondary locking member from accidentally being pushed from the pre-assembly to the fully locked position during handling and transport. In the latter example, the secondary locking or terminal position assurance member is moveable in the mating direction from the pre-assembly to the fully locked position. The shroud thus extends beyond the mating face of the fully assembled connector, thereby increasing the length of the connector. In certain applications, in particular where the connector mates against a solid structure or wall, the shroud prevents the connector from approaching the wall up to the mating face. This may require longer contacts, which increases the cost and volume of the connector system.

It would be desirable to provide a more compact connector with terminal position assurance, that nevertheless enables the connector assembly to be provided as a pre-assembled unit that can be easily handled without accidentally engaging the terminal position assurance member.

SUMMARY OF THE INVENTION

An aspect of this invention is to provide an electrical connector comprising a housing having cavities extending therethrough from a conductor receiving end to a mating end, the housing comprising a first housing member and a terminal position assurance member, the terminal position assurance member being moveable from a pre-assembly position to a fully locked position such that in the pre-assembly position terminals can be assembled to the housing, and in the fully locked position the member blocks locking lances of the housing that engage the terminals, characterized in that the terminal position assurance member moves transversely to the mating direction. Advantageously, the terminal position assurance member is protected in its pre-assembly position, but nevertheless enables the connector mating face to be flush with an outer shroud of the housing.

Preferably, the shroud is moved from the pre-assembly to the fully locked position in a movement that is directed toward the locking lances. A cutout in a top wall of the connector housing can be provided to enable a terminal position assurance member to be depressed by finger action therethrough. In the pre-assembly position, the terminal position assurance member is received within the housing in such a manner that an outer wall of the housing is provided to prevent an external object from accidentally displacing the member form the pre-assembly to the fully locked position. In other words the portion of terminal position assurance member accessible to the exterior for displacing the member from the pre-assembly to the locked position does not project beyond an outer surface of the housing. Accidental displacement is thus rendered difficult.

Further advantageous features will be apparent from the following description and drawings, or the claims.

DETAILED DESCRIPTION OF THE PREFERRED EMBODIMENT

Figure 3:
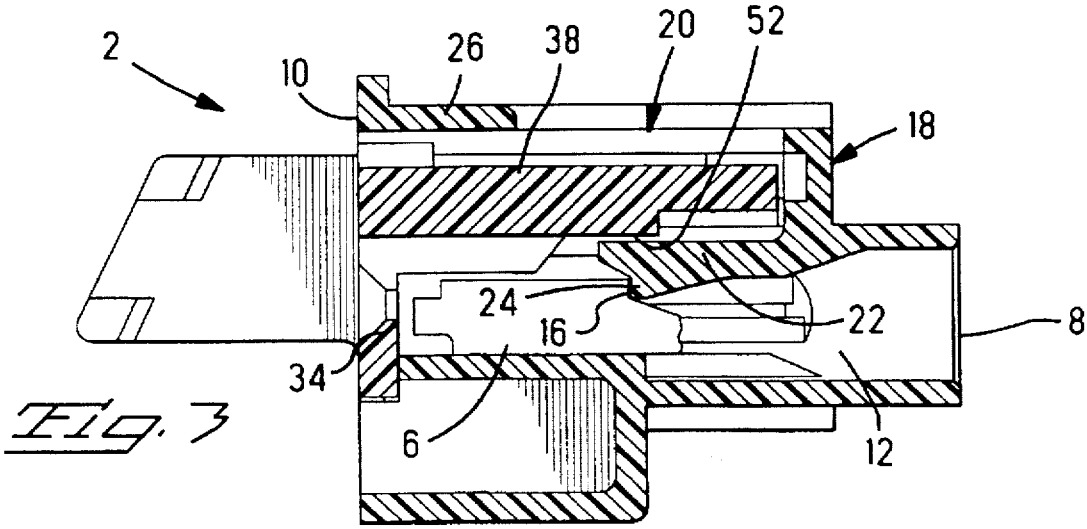
FIG. 3 is similar to that of FIG. 2, but with the terminal position assurance member in a fully locked position.
Figure 5:
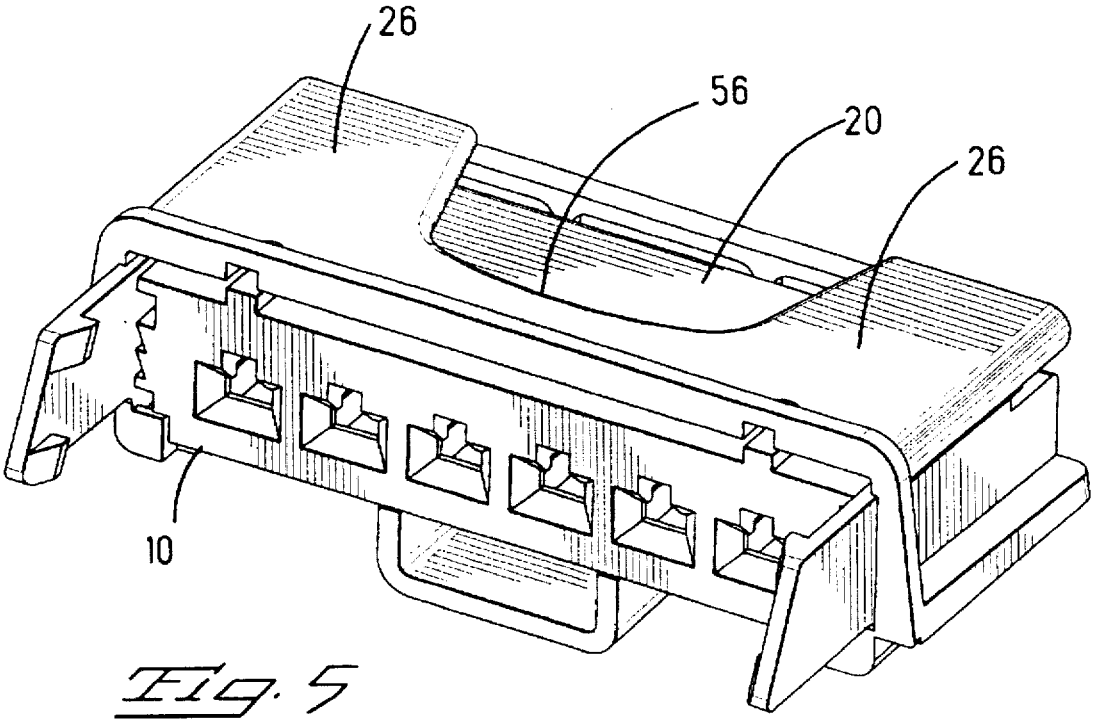
FIG. 5 is a view similar to that of FIG. 4 with the connector in the fully locked position.

Referring mainly to FIGS. 3 and 5, an electrical connector 2 comprises a housing 4 and terminals 6 (the terminal is shown only partially i.e. without connection end). The housing 4 extends from a terminal receiving end 8 to a mating end 10. The connector 4 is pluggable to a complementary connector (not shown) in a mating direction M. The housing 4 is provided with terminal receiving cavities 12 extending from the terminal receiving end 8 to the mating end 10 and receiving the terminals 6 therein. Each terminal 6 is provided with a body 14 having a locking shoulder 16.

Figure 1:
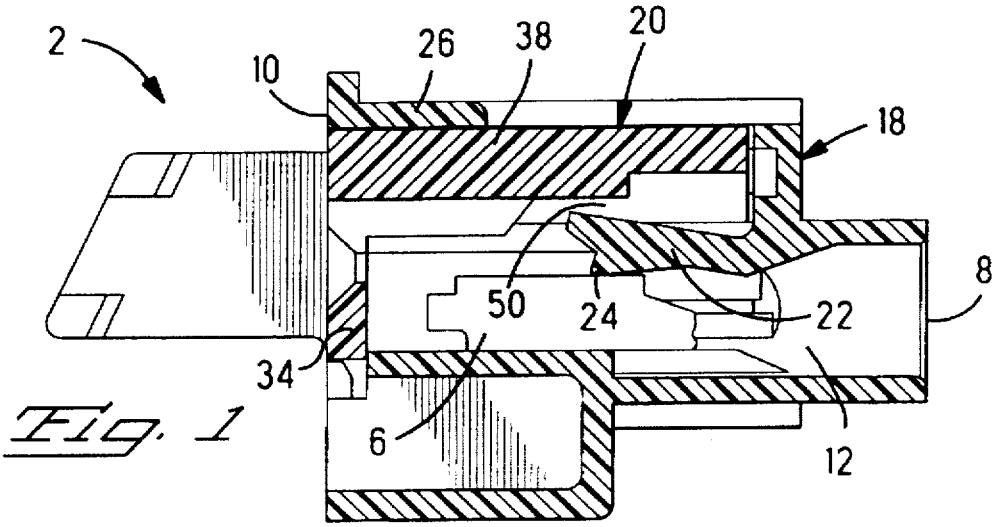
FIG. 1 is a cross-sectional view through a connector according to this invention showing a terminal being inserted into a terminal receiving cavity of a housing.

The housing 4 is provided with a first housing member 18 and a terminal position assurance member 20. The first housing member 18 is provided with resilient locking lances 22 integral therewith, in the shape of cantilever beams and having a locking protrusion 24 proximate the free end for engaging the locking shoulders 16 of the terminals 14 when fully inserted into the cavities 12. As shown in FIG. 1, during insertion of the terminal 6 within the housing cavity 12, the lance 22 is resiliently outwardly biased whereby the projection 24 rides over the terminal.

Figure 6:
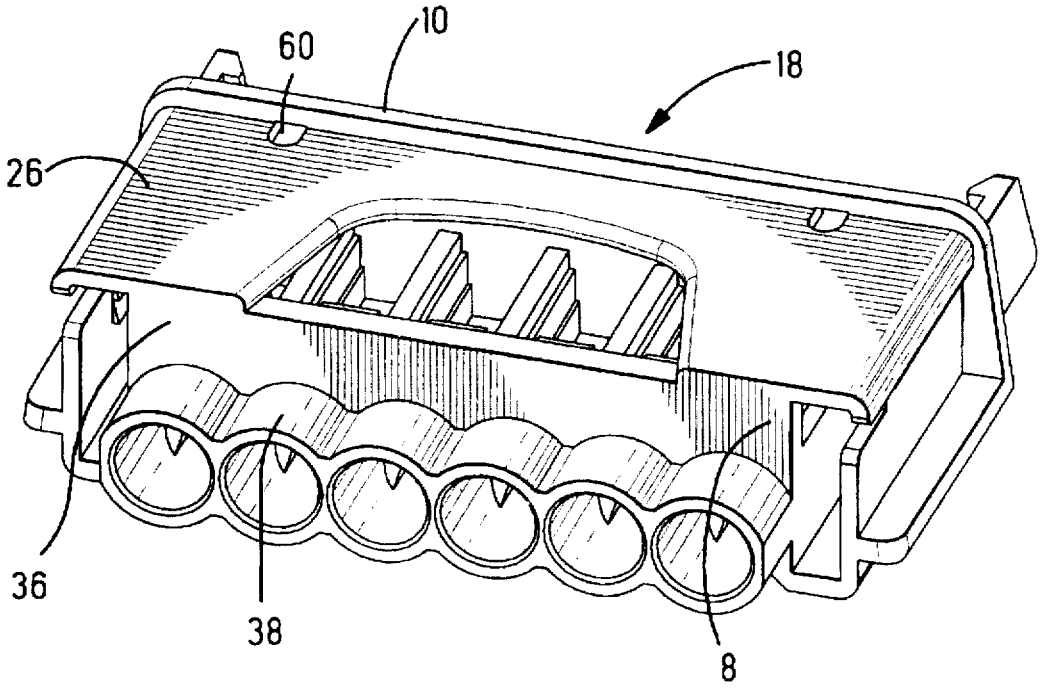
FIG. 6 is an isometric view of a first housing member looking towards the terminal receiving end.
Figure 7:
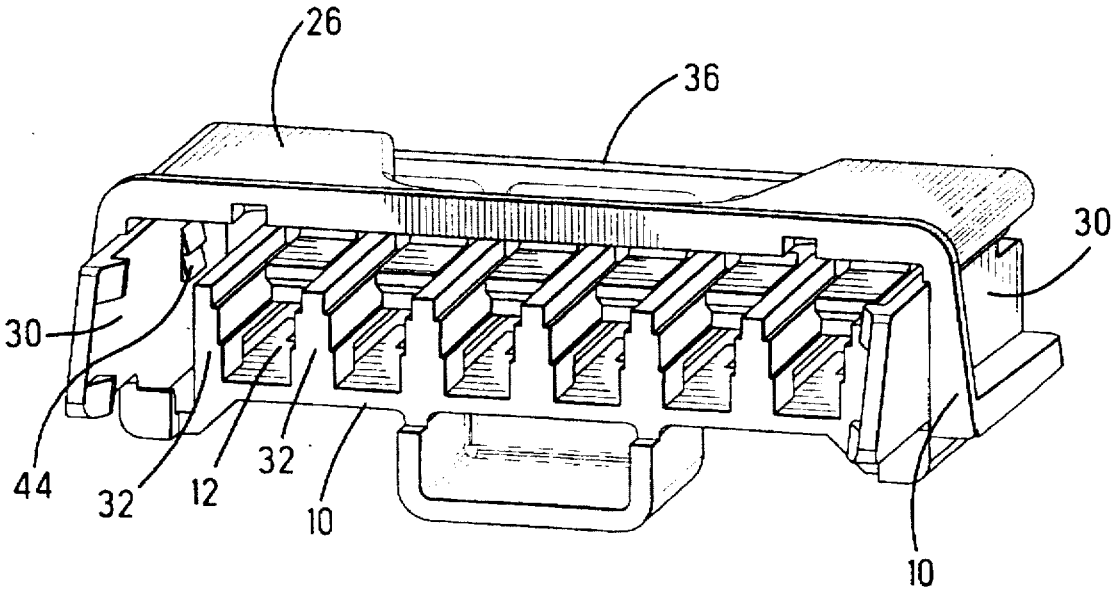
FIG. 7 is an isometric view of the housing member of FIG. 6 looking towards the mating end.

Referring to FIGS. 6 and 7, the first housing member 18 is shown, and comprises a top wall 26 opposed to a bottom wall 28, and extending therebetween at lateral ends are side-walls 30. Extending from the bottom wall 28 towards the top wall 26, are separation walls 32 that define the terminal receiving cavities 12. The separation walls 32 do not extend right up to the top wall 26, thereby leaving a space enabling the terminal position assurance member to be inserted therein. The separation walls 32 do not extend right up to the mating end 10 of the top and side-walls 26,30 thereby providing a space to enable the terminal assurance member to provide a front or mating end wall 34 (see FIGS. 8 and 9) of the connector. The first housing member 18 further comprises a back or terminal receiving end wall 36 provided with inlets (see FIG. 6) 38 to enable insertion of the terminals therethrough into the cavities 12.

Figure 8:
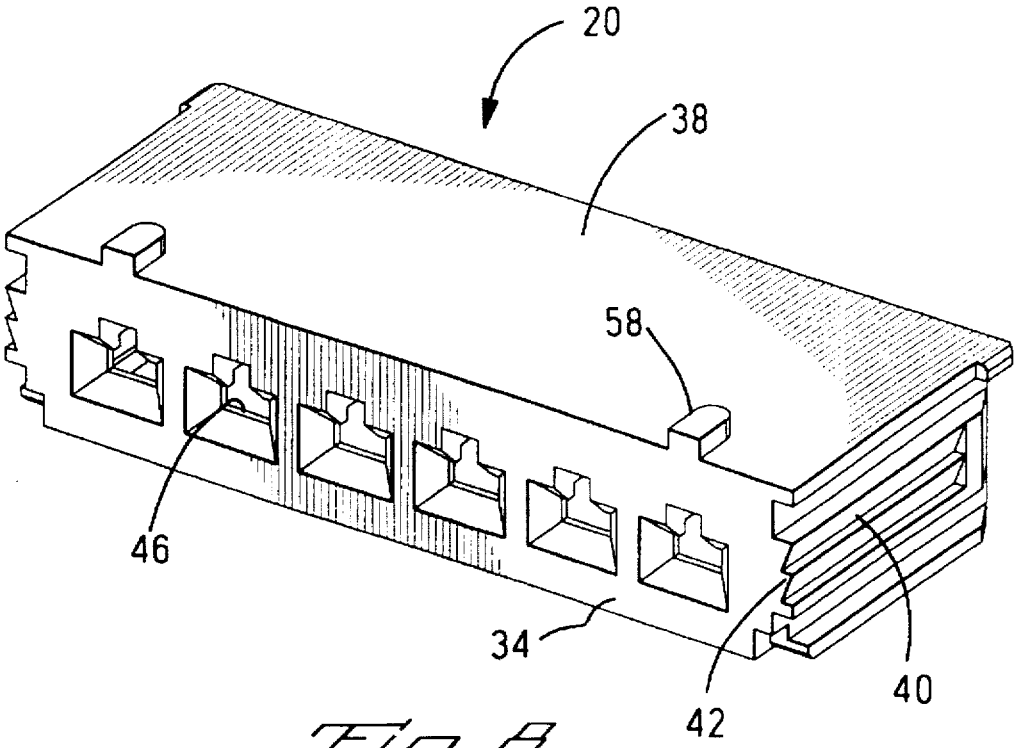
FIG. 8 is an isometric view of a terminal position assurance member looking towards the mating end.
Figure 9:
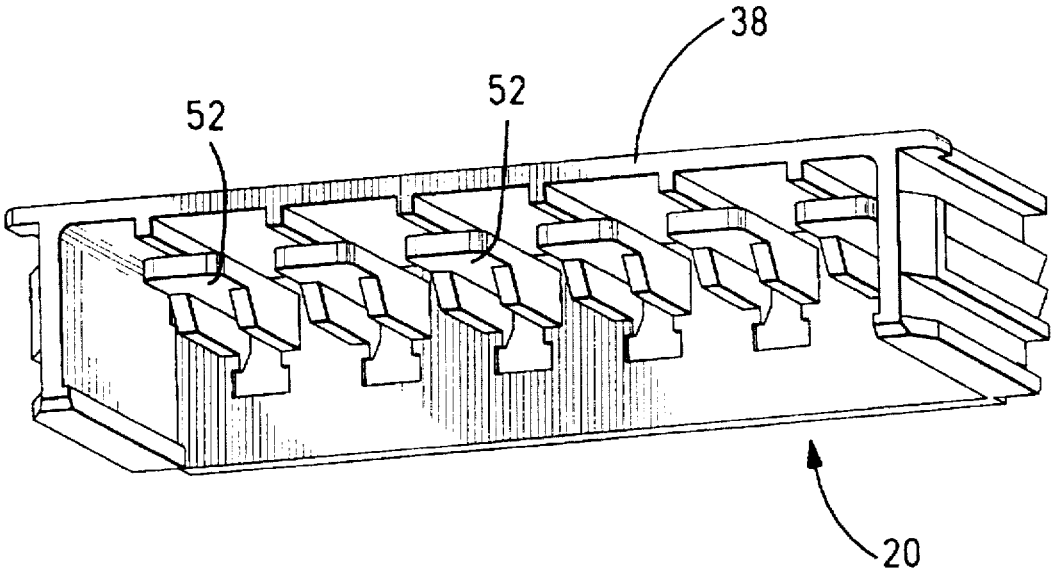
FIG. 9 is an isometric view of the terminal position assurance member looking towards the terminal receiving end.

Referring to FIGS. 8 and 9 the terminal position assurance member 20 comprises the connector front wall 34, a top wall 38 and side-walls 40. The side-walls 40 are provided with retaining projections 42 that cooperate with corresponding retaining protrusions 44 (see FIG. 7) projecting inwardly from the side-walls 30 of the first housing member 18. The retaining protrusions 42,44 enable the terminal position assurance member to be securely locked in the fully locked position where terminals are securely retained in the cavities 12. The front wall 34 is provided with cutouts 46 to enable insertion of complementary terminals of a complementary connector therethrough.

Figure 2:
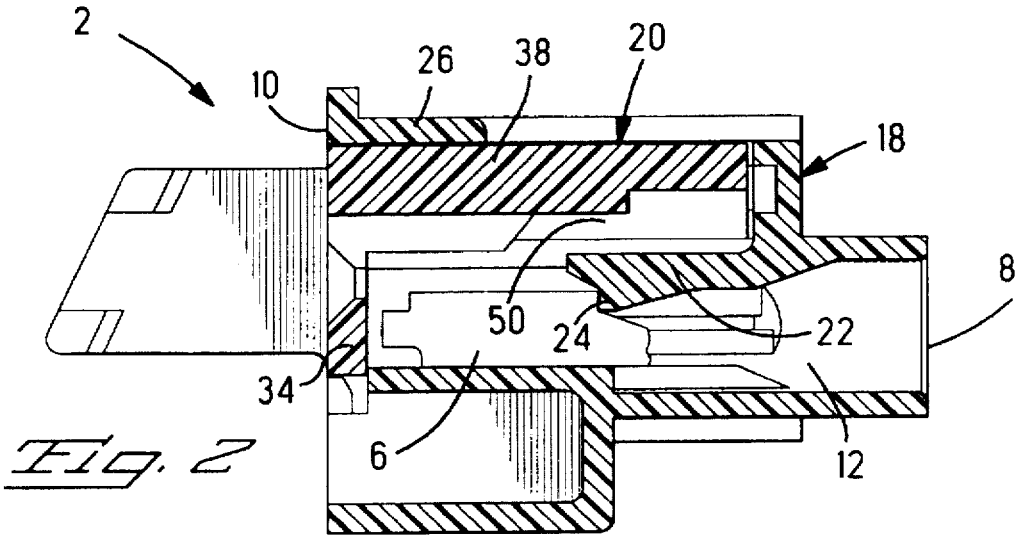
FIG. 2 is a view similar to FIG. 1, but with the terminal fully inserted in a cavity of the housing and with a terminal position assurance member in a pre-assembly position.
Figure 4:
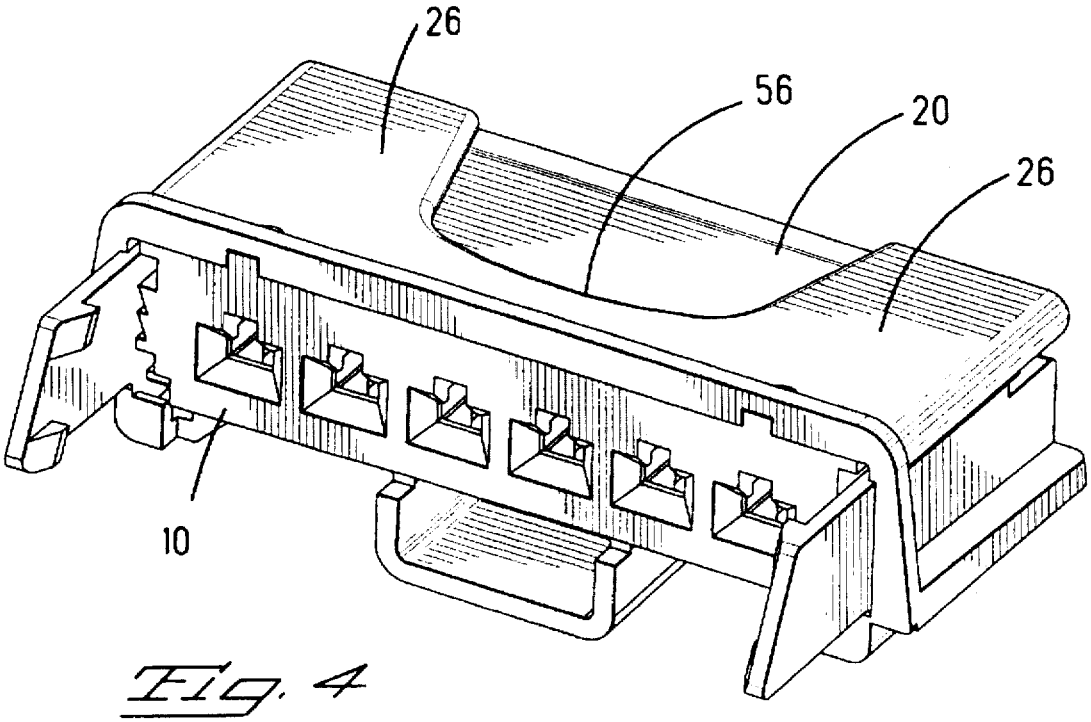
FIG. 4 is an isometric view of the connector of FIG. 1, looking towards the mating face and with the terminal position assurance member in the pre-assembly position.

Referring to FIGS. 1,2 and 4 the terminal position assurance member 20 is shown in the pre-assembled position. The member 20 is assembled into the first housing member 18 by sliding it in the mating direction M into the cavity area or gap between the separation walls 32 and the top walls 26. In the pre-assembly position, the assurance member front wall 34 is flush with the mating end 10 of the first housing member outer walls 26,30. Furthermore, the assurance member top wall 38 is substantially against the inside of the first housing member top wall 36. A gap 50 is provided between the assurance member and the locking lances 22 to enable resilient outward biasing thereof. As can be seen in FIG. 9, the terminal position assurance member top wall 38 is provided with protrusion or wall portions 52 for positioning proximate the locking lances in the fully locked position.

Once all of the terminals have been inserted into the cavities 12, the position assurance member 20 is depressed toward the locking lances 22 to move into the fully locked position as shown in FIG. 3, whereby the wall portions 52 are proximate the locking lances 22 thereby blocking outward biasing thereof. The terminal position assurance member 20 is held in the fully locked position by engagement of the retention protrusions 42 with the retention protrusions 44 of the first housing member 18.

As can be seen in FIGS. 3 and 4 the first housing member top wall 26 is provided with a cutout 56 that enables depression of the terminal position assurance member into the fully locked position, for example with a finger. As the terminal position assurance member does not have portions projecting outside of the first housing member 18, it is protected from accidental displacement by external objects into the fully locked position, for example during handling or transport. In view of the transverse displacement of the terminal position assurance member with respect to the first housing member 18, protection is achieved whilst enabling the connector to have a mating face 10 of the outer shroud or walls 26,30 that do not extend beyond the front wall 34 of the connector.

The terminal position assurance member can be provided with protrusions 58 that extend through cutouts 60 (see FIGS. 8 and 6) of the housing member top wall 26 that indicate that the terminal position assurance member is in the pre-assembly position, or in the locked position. The latter is particularly useful when the terminal position assurance member and housing are of different colors, providing a reliable visual indication of the state of assembly of the connector.

We claim:

1. A connector comprising a housing having terminal receiving cavities extending therethrough from a terminal receiving end to a mating end, and locking lances for locking terminals in the cavities; the connector having a first housing member and a terminal position assurance member mountable in the first housing member in a pre-assembly position such that terminals can be inserted into the housing cavities, and moveable to a fully locked position adjacent the locking lances such that unlocking of the terminals by biasing of the lances is prevented, characterized in that the position assurance member is moveable transversely to a mating direction of the connector from the pre-assembly to the locked position, the position assurance member being surrounded and protected by outer walls of the first housing member that prevent external objects from accidentally displacing the assurance member when it is in the pre-assembly position.

2. The connector of claim 1 wherein the terminal position assurance member is positioned and spaced above the locking lances in the pre-assembly position, and moveable in a direction theretowards into the locked position.

3. The connector of claim 1 wherein the terminal position assurance member comprises a mating end wall of the connector substantially flush with a mating end of the first housing member.

4. The connector of claim 1 wherein the first housing member has a top wall and side-walls forming an enclosure for surrounding the terminal position assurance member.

5. The connector of claim 4 wherein in the pre-assembly position, the position assurance member is positioned substantially against an inner surface of the top wall.

6. The connector of claim 4 wherein the top wall comprises a cutout to enable passage of a finger therethrough for displacing the assurance member to the locked position.

7. A connector comprising a housing having terminal receiving cavities extending therethrough from a terminal receiving end to a mating end, and locking lances for locking terminals in the cavities; the connector having a first housing member and a terminal position assurance member mountable in the first housing member in a pre-assembly position such that terminals can be inserted into the housing cavities, and moveable to a fully locked position adjacent the locking lances such that unlocking of the terminals by biasing of the lances is prevented, wherein the position assurance member is moveable transversely to a mating direction of the connector from the pre-assembly to the locked position, the position assurance member being surrounded and protected by outer walls of the first housing member that prevent external objects from accidentally displacing the assurance member, and wherein the terminal position assurance member is positioned and spaced above the locking lances in the pre-assembly position, and moveable in a direction theretowards into the locked position.

8. The connector of claim 7 wherein the terminal position assurance member comprises a mating end wall of the connector substantially flush with a mating end of the first housing member.

9. The connector of claim 7 wherein the first housing member has a top wall and side-walls forming an enclosure for surrounding the terminal position assurance member.

10. The connector of claim 9 wherein in the pre-assembly position, the position assurance member is positioned substantially against an inner surface of the top wall.

11. The connector of claim 9 wherein the top wall comprises a cutout to enable passage of a finger therethrough for displacing the assurance member to the locked position.

* * * * *